US011299954B2

(12) United States Patent
Huang et al.

(10) Patent No.: US 11,299,954 B2
(45) Date of Patent: Apr. 12, 2022

(54) FRACTURING RELIEF METHOD FOR STRESS CONCENTRATION OF REMAINING ORE PILLARS IN OVERLYING GOAF

(71) Applicants: China University of Mining and Technology, Jiangsu (CN); XUZHOU USURE MINING TECHNOLOGY CO., LTD, Jiangsu (CN)

(72) Inventors: Bingxiang Huang, Jiangsu (CN); Luying Shao, Jiangsu (CN); Xinglong Zhao, Jiangsu (CN); Shuliang Chen, Jiangsu (CN)

(73) Assignees: China University of Mining and Technology, Jiangsu (CN); XUZHOU USURE MINING TECHNOLOGY CO., LTD, Jiangsu (CN)

( * ) Notice: Subject to any disclaimer, the term of this patent is extended or adjusted under 35 U.S.C. 154(b) by 81 days.

(21) Appl. No.: 16/768,889

(22) PCT Filed: Nov. 2, 2018

(86) PCT No.: PCT/CN2018/113595
§ 371 (c)(1),
(2) Date: Jun. 2, 2020

(87) PCT Pub. No.: WO2019/227852
PCT Pub. Date: Dec. 5, 2019

(65) Prior Publication Data

US 2021/0348471 A1 Nov. 11, 2021

(30) Foreign Application Priority Data

May 31, 2018 (CN) ..... 201810549872.1

(51) Int. Cl.
*E21B 43/26* (2006.01)
*E21B 33/12* (2006.01)
(Continued)

(52) U.S. Cl.
CPC ..... *E21B 33/12* (2013.01); *E21B 4/02* (2013.01); *E21B 23/06* (2013.01); *E21B 43/26* (2013.01)

(58) Field of Classification Search
CPC ..... E21B 33/12; E21B 4/02; E21B 23/06
See application file for complete search history.

(56) References Cited

U.S. PATENT DOCUMENTS 3,948,055 A 4/1976 Choi et al.
2016/0356138 A1 12/2016 Hughes et al.

FOREIGN PATENT DOCUMENTS

CN 103527198 A * 1/2014
CN 103758570 4/2014
(Continued)

OTHER PUBLICATIONS

"International Search Report (Form PCT/ISA/210) of PCT/CN2018/113595", dated Mar. 6, 2019, with English translation thereof, pp. 1-4.

*Primary Examiner* — Steven A MacDonald
(74) *Attorney, Agent, or Firm* — JCIPRNET

(57) ABSTRACT

Provided is a fracturing relief method for stress concentration of remaining ore pillars in an overlying goaf, including first, performing directional fracturing on a roof to optimize the stress of the roof and reduce the source of force; secondly, performing pulse fracturing on a coal pillar to produce a crack network, weaken the stiffness of the coal pillar and reduce the bearing capacity of the coal pillar; and finally, performing pulse fracturing on a floor strata of the coal pillar to reduce the ability of transferring stress concentration thereof. A drilling machine is used for separately constructing fracturing drill holes in a roadway to a set depth at an interval in a direction oblique to the coal pillar in an upper goaf. The roof, the coal pillar and the floor can be fractured by an oblique fracturing hole in a sublevel retreat-
(Continued)

ing manner. The position of the directional fracturing of the roof is approximately 1 m above the middle of a main roof above the coal pillar. The method reduces the width of the lower coal pillar, improves the coal mining rate, reduces the deformation of the lower coal roadway, effectively solves the problems of mine pressure passing through the coal pillar on the working face of the lower coal seam, rock burst, and coal and gas outburst in the mining of the lower coal seam, and simultaneously has the advantages of high safety factor, simple method, convenient construction and low cost.

9 Claims, 2 Drawing Sheets

(51) Int. Cl.
*E21B 4/02* (2006.01)
*E21B 23/06* (2006.01)

(56) References Cited

FOREIGN PATENT DOCUMENTS

| | | | | |
|---|---|---|---|---|
| CN | 103758570 | A | * | 4/2014 |
| CN | 104564137 | A | * | 4/2015 |
| CN | 105019935 | A | * | 11/2015 |
| CN | 106368701 | | | 2/2017 |
| CN | 107083959 | A | * | 8/2017 |
| CN | 107304676 | | | 10/2017 |
| CN | 108894784 | A | * | 11/2018 |
| CN | 108894787 | A | * | 11/2018 |
| CN | 109958421 | A | * | 7/2019 |
| CN | 111271120 | A | * | 6/2020 |
| CN | 111927456 | A | * | 11/2020 |
| CN | 112554888 | A | * | 3/2021 |
| RU | 2487246 | | | 7/2013 |

* cited by examiner

FRACTURING RELIEF METHOD FOR STRESS CONCENTRATION OF REMAINING ORE PILLARS IN OVERLYING GOAF

CROSS-REFERENCE TO RELATED APPLICATION

This application is a 371 of international application of PCT application serial no. PCT/CN2018/113595, filed on Nov. 2, 2018, which claims the priority benefit of China application no. 201810549872.1, filed on May 31, 2018. The entirety of each of the above mentioned patent applications is hereby incorporated by reference herein and made a part of this specification.

BACKGROUND

Technical Field

The present invention relates to a fracturing relief method for stress concentration of remaining ore pillars in an overlying goaf, which belongs to the technical field of mining.

Description of Related Art

Long wall mining is adopted for most underground coal mines. The air return roadway or transportation roadway on the side of goaf is usually separated from the goaf by arranging coal pillars. On the one hand, the stability of the surrounding rock of the roadway on the side of the goaf is ensured; and on the other hand, the coal pillars can play a sealing role, thus isolating harmful gas in the goaf, preventing air leakage, spontaneous combustion of coal, etc. The width of the arranged coal pillars is generally determined according to the thickness, hardness and integrity of the coal seam.

Room and pillar mining is adopted for most non-coal underground mines. In order to control the surrounding rock of the mined seam, a large number of ore pillars will be left after mining.

Mining of close-distance coal seam group or ore bed group often occurs in underground mines. In addition to mining the protective coal seam, downward mining is generally adopted. When mining coal pillars or coal seams or mine bodies under pillars, stress concentration will occur, which will cause the problems of large deformation of the lower roadway and rock pressure passing through the coal pillar on the working face of the lower coal seam, and the problems of abnormal pressure or support crushing on the working face, rock burst, and coal and gas outburst in the mining of the lower coal seam.

When the problem of large deformation of the lower roadway occurs, in order to ensure the stability of the coal pillar and reduce the deformation of the roadway, the method of enlarging the coal pillar and arranging the roadway of the lower coal seam below the goaf of the upper coal seam is generally adopted. It is also possible to reduce the deformation of the roadway by strengthening the support of the roadway, such as using the combined support technology of bolts, cables, steel sheds and timber pillars. However, there are the following problems when the method of enlarging the coal pillar is adopted: (a) two-seam coal: the loss of the coal pillar in the lower seam is increased, the coal mining rate is reduced and the resources are wasted; and (b) multi-seam coal: the method of enlarging the coal pillar is adopted for multi-seam mining, the coal pillar is caused to be larger and larger, and a lot of resources are wasted; once the left width of the coal pillar is not favorable, it will also cause pillar instability and bring a large hidden danger to safety production. The use of the combined support technology of bolts, cables, steel sheds and timber pillars will largely increase the cost of roadway support.

When the problem of rock pressure passing through the coal pillar on the working face of the lower coal seam occurs, roof management strengthening is generally adopted to ensure that the hydraulic support is tightly roofed and the support strength meets the regulations, and the phenomena of empty roof and non-roofed connection are strictly prohibited. It is also necessary to strengthen on-site management, standardize on-site behaviors of workers, maintain normal attendance, and take a series of measures to ensure safe work and normal organization of production. However, the measures of strengthening roof management and on-site management have not really relieved the problem of stress concentration of remaining coal pillars in the overlying goaf, and it is still prone to safety accidents due to mining.

When the problems of rock burst and coal and gas outburst occur in the mining of the lower coal seam, water infusion can be used to wet the coal body. Water infusion can change the physical and mechanical properties of the coal body, weaken the structure of the coal body, and reduce the impact tendency of the coal body. Large-diameter pressure relief drilling can also be carried out in the delineated dangerous areas to reduce the bearing capacity and transfer stress. Methods of mining the protective seam and pre-draining the coal seam gas may also be used. However, when the method of coal seam water infusion is adopted, the effect on solving the problem of rock burst is not remarkable, and the time of water infusion is longer. When large-diameter pressure relief drilling is adopted, dense holes are usually arranged, the number of the holes is large and the labor cost is large; the mining of the protective seam is restricted by the distance between coal seams.

In order to solve the above problems, the most common method is to use explosives to break the coal pillar, so as to relieve the stress concentration of the coal pillar. However, the following problems exist in the method of using explosives to break the coal pillar:

a. the traditional safety management of blasting to cave the roof is complex: it involves the management and transportation of explosives and detonators, and the blasting should strictly implement some systems such as "blasting once checking gas three times" and "three-man linkage blasting";

b. there are potential safety hazards: practice shows that a large number of harmful gases such as CO produced instantaneously by large-scale blasting have a tremendous impact on mine ventilation safety management; for high-gas underground mines, it is not suitable to adopt blasting to break the coal pillar because of the potential danger of gas explosion induced by blasting sparks; and c. the economic cost of blasting is high: when the coal pillar is broken, the spacing between blast holes is usually very small, and therefore a large number of explosives and initiating explosive devices such as detonators are needed.

SUMMARY

In order to overcome various shortcomings of the prior art, the present invention provides a fracturing relief method for stress concentration of remaining ore pillars in an overlying goaf, which reduces the width of the lower coal pillar, improves the coal mining rate, reduces the deformation of the lower coal roadway, effectively solves the problems of mine pressure passing through the coal pillar on the working face of the lower coal seam, rock burst, and coal and gas outburst in the mining of the lower coal seam, and simultaneously has the advantages of high safety factor, simple method, convenience in construction and low cost.

In order to solve the above problems, the fracturing relief method for stress concentration of remaining ore pillars in an overlying goaf provided by the present invention includes the following steps:

step 1: separately constructing three rows of fracturing drill holes in a roadway to a set depth at an interval in a direction oblique to a coal pillar in an upper goaf by using a drilling machine, where the position of the final hole of the first row of fracturing drill holes is approximately 1 m above the middle of a main roof above the coal pillar, the position of the final hole of the second row of fracturing drill holes is approximately 1 m above the middle of the coal pillar, and the position of the last hole of the third row of fracturing drill holes is at ¾ of the section of the coal pillar;

step 2: mounting and commissioning a hydraulic fracturing high-pressure pump and a hydraulic fracturing pulse pump;

step 3: sending a packer to the to-be-fractured area of a to-be-fractured drill hole, sequentially connecting a high-pressure seal mounting rod, a transfer joint and a high-pressure pipeline, and separately connecting the high-pressure pipeline to the hydraulic fracturing pulse pump and the hydraulic fracturing high-pressure pump through a three-way valve;

step 4: performing high-pressure hydraulic fracturing on the main roof area in the first row of drill holes, and then performing pulse hydraulic fracturing on the coal pillar area in the first row of drill holes;

step 5: performing pulse hydraulic fracturing on the second row of drill holes; and step 6: performing pulse hydraulic fracturing on the coal pillar area in the third row of drill holes, and then performing pulse hydraulic fracturing again on a floor area in the third row of drill holes.

Since after the upper coal seam of the close-distance coal seam group is mined out, the weight of the overlying strata first act on the hard main roof of the goaf and then act on the stable coal pillar through the hard roof, and then the stress is propagated downwards through the coal pillar and affects the mining activity of the lower coal seam. However, the stress cannot be removed and can only be transferred. Therefore, the stress concentration of the remaining coal pillar is required to be reduced to realize the purpose of transferring the stress to the goaf and fracture the roof to optimize the stress of the roof. By performing high-pressure fracturing on the first row of drill holes, the drill holes in the hard roof above the coal pillar are directionally fractured, thus effectively optimizing the stress above the coal pillar and reducing the source of the force. For the coal pillar itself, the main purpose is to produce as many dense cracks as possible to break the coal pillar and reduce the stiffness of the coal pillar, thus reducing the bearing capacity of the coal pillar. By performing hydraulic fracturing, the floor strata of the coal pillar are weakened, thus weakening the ability to transfer stress concentration.

Specifically, in step 4, the specific step of performing hydraulic fracturing on the first row of drill holes includes the following steps:

(a) connecting the high-pressure seal mounting rod with the packer, sending the packer to a corresponding first-row drill hole main roof fracturing zone in the first fracturing drill hole of the first row, then connecting the high-pressure pipeline connected to the hydraulic fracturing high-pressure pump and the hydraulic fracturing pulse pump onto the high-pressure seal mounting rod, and using a hand pump to infuse high-pressure water into the packer through a high-pressure thin hose to enable the packer to be expanded and seal the hole, where a pressure relief valve and a hydraulic fracturing measuring and controlling instrument are arranged on the high-pressure pipeline;

(b) closing a switch valve II, opening a switch valve I, turning on the hydraulic fracturing high-pressure pump, and infusing high-pressure water into the drill hole through the high-pressure pipeline to perform hydraulic fracturing; when the construction pressure monitored by the hydraulic fracturing measuring and controlling instrument is smaller than 5 MPa or when the coal seam "sweats" for more than 5-7 min, turning off the hydraulic fracturing high-pressure pump and opening the pressure relief valve;

(c) sublevel retreating fracturing is adopted. retreating the packer to a corresponding first-row drill hole coal pillar fracturing zone, sealing the hole again, closing the switch valve I, opening the switch valve II, and performing fracturing again by using the hydraulic fracturing pulse pump; and (d) removing the packer and the high-pressure seal mounting rod.

Specifically, in step 5, the specific step of performing hydraulic fracturing on the second row of drill holes includes the following steps:

(a) connecting the high-pressure seal mounting rod with the packer, sending the packer to a corresponding second-row drill hole coal pillar fracturing zone in the first fracturing drill hole of the second row, then connecting the high-pressure pipeline connected to the hydraulic fracturing high-pressure pump and the hydraulic fracturing pulse pump onto the high-pressure seal mounting rod, and using a hand pump to infuse high-pressure water into the packer to enable the packer to be expanded and seal the hole, where a pressure relief valve and a hydraulic fracturing measuring and controlling instrument are arranged on the high-pressure pipeline;

(b) closing a switch valve I, opening a switch valve II, turning on the hydraulic fracturing pulse pump, and infusing pulse water into the first fracturing drill hole of the second row through the high-pressure pipeline to perform hydraulic fracturing; when the construction pressure monitored by the hydraulic fracturing measuring and controlling instrument is smaller than 5 MPa or when the coal seam "sweats" for more than 5-7 min, turning off the hydraulic fracturing pulse pump and opening the pressure relief valve; and (c) removing the packer and the high-pressure seal mounting rod.

Specifically, in step 6, the specific step of performing hydraulic fracturing on the third row of drill holes includes the following steps:

(a) connecting the high-pressure seal mounting rod with the packer, sending the packer to a corresponding third-row drill hole coal pillar fracturing zone in the first fracturing drill hole of the third row, then connecting the high-pressure pipeline connected to the hydraulic fracturing high-pressure pump and the hydraulic fracturing pulse pump onto the high-pressure seal mounting rod, and using a hand pump to infuse high-pressure water into the packer to enable the packer to be expanded and seal the hole, where a pressure relief valve and a hydraulic fracturing measuring and controlling instrument are arranged on the high-pressure pipeline;

(b) closing a switch valve I, opening a switch valve II, turning on the hydraulic fracturing pulse pump, and infusing pulse water into the first fracturing drill hole of the third row through the high-pressure pipeline to perform hydraulic fracturing; when the construction pressure monitored by the hydraulic fracturing measuring and controlling instrument is smaller than 5 MPa or when the coal seam "sweats" for more than 5-7 min, turning off the hydraulic fracturing pulse pump and opening the pressure relief valve;

(c) sublevel retreating fracturing is adopted. retreating the packer to a corresponding third-row drill hole floor fracturing zone, sealing the hole again, closing the switch valve I again, opening the switch valve II, and performing fracturing again by turning on the hydraulic fracturing pulse pump; and (d) removing the packer and the high-pressure seal mounting rod.

Pulse fracturing is used for the coal pillar and the floor of the coal pillar. The pulsating water pressure propagates in a sinusoidal mode. When the pulsating pressure wave propagates to the interface between water and coal at the crack tip, it produces pulsating incident waves and pulsating reflected waves, and the reflection, superposition and reciprocation of the pulsating pressure waves cause the phenomena of the amplitude expansion of the pulsating pressure waves and increase of pressure; because of the effect of friction resistance, the phenomenon of pressure increase is also caused at the crack tip; and since the pulsating pressure will cause fatigue damage to the coal body, the pulsating pressure waves can produce more cracks under the effect of small pulsating pressure.

By adopting sublevel retreating hydraulic fracturing for the first row of fracturing holes and the second row of fracturing holes, the utilization rate of drill holes is further improved. The specific steps include:

(a) turning on the hydraulic fracturing high-pressure pump or the hydraulic fracturing pulse pump;

(b) infusing water into a fracturing drill hole and performing a cycle of hydraulic fracturing;

(c) when the hydraulic fracturing measuring and controlling instrument monitors that the water pressure of the fracturing drill hole is smaller than 5 MPa or the coal seam "sweats" for more than 5-7 min, turning off the hydraulic fracturing high-pressure pump or the hydraulic fracturing pulse pump, and opening the pressure relief valve to complete this cycle of hydraulic fracturing;

(d) retreating the packer for 5-20 m towards the hole mouth of the drill hole, and performing a cycle of hydraulic fracturing again; and (e) retreating the packer to complete the sublevel retreating hydraulic fracturing.

Further, both drill holes and hydraulic fracturing are constructed sequentially according to a sequence of the first fracturing drill hole of the first row, the first fracturing drill hole of the second row, the first fracturing drill hole of the third row, the second fracturing drill hole of the first row, the second fracturing drill hole of the second row, the second fracturing drill hole of the third row . . . ; the hydraulic fracturing sequence and the hole drilling construction sequence are the same, hydraulic fracturing and hole drilling are synchronously performed in parallel, and the construction speed matches.

Further, a group of fracturing areas for directional fracturing are arranged in the main roof above the coal pillar; three groups of fracturing areas are arranged in the coal pillar; a group of fracturing areas are arranged in the floor below the coal pillar.

After mining of the working faces on the two sides of the coal pillar, because of the bending and subsidence of the roof above the goaf, the edge of the coal pillar deforms and is broken due to the impact of the bending and subsidence of the roof, and therefore the fracturing position of the roof above the coal pillar is generally selected to be just above the coal pillar in elastic-plastic deformation, i.e., above the central position of the coal pillar; when the width of the coal pillar is large, fracturing the roof from positions above the two sides of the coal pillar may also be considered; since the coal pillar is the main bearing area of stress concentration, three fracturing positions are provided, which are respectively located in the middle of the coal pillar and on the two sides of the coal pillar, and the three fracturing positions are selected to be within the range of the coal pillar in elastic-plastic deformation; the fracturing positions in the floor below the coal pillar are selected according to the same selection basis as the fracturing positions in the roof, the fracturing position is located at the hard floor just below the center of the coal pillar, the floor is fractured by adopting pulse hydraulic fracturing, the floor is fully broken and the ability thereof to transfer stress concentration is weakened.

First, the core of the method of the present invention is to optimize the stress of the roof through directional fracturing of the roof and reduce the source of the force; secondly, pulse fracturing is performed on the coal pillar to produce a crack network, weaken the stiffness of the coal pillar and reduce the bearing capacity of the coal pillar; finally, pulse fracturing is performed on the floor strata of the coal pillar to weaken the ability to transfer stress concentration.

By arranging a row of fracturing holes in the main roof above the coal pillar, three rows of fracturing holes in the coal pillar, and a row of fracturing holes in the hard floor below the coal pillar, respectively using high-pressure and pulse hydraulic fracturing to fracture the first row of drill holes, using pulse hydraulic fracturing to fracture the second row of drill holes and using pulse hydraulic fracturing to fracture the third row of drill holes, the cracks are enabled to be started and extended along the prefabricated cracks of the fracturing drill holes under the effect of high-pressure and pulse water; by controlling the spacing of the fracturing holes, the hydraulic fracturing zones of adjacent drill holes can penetrate through to realize the hydraulic fracturing of the overlying coal pillar, the hard roof of the coal pillar and the hard floor of the coal pillar. In a given space, the coal and rock bodies are enabled to produce many cracks, which split the coal seams and rock strata into blocks or layers with a particular size and shape, the integrity of the rock and coal seam is destroyed, and the strength of the rock body is reduced, so as to achieve the effect of breaking the overlying coal pillar, the hard main roof above the coal pillar and the hard floor below the coal pillar. This method is conducive to the treatment of the overlying remaining coal pillars, reduces the width of the lower coal pillar, improves the coal mining rate, reduces the deformation of the lower coal roadway, and effectively solves the problems of rock pressure passing through the coal pillar on the working face of the lower coal seam, rock burst, and coal and gas outburst in the mining of the lower coal seam. The potential safety hazards caused by use of explosive for breaking the coal pillar and management of initiating explosive devices are eliminated, and the cost per ton of coal is reduced. Moreover, this method is simple, convenient, safe and reliable, and has a good effect and wide practicability.

Figure 1:
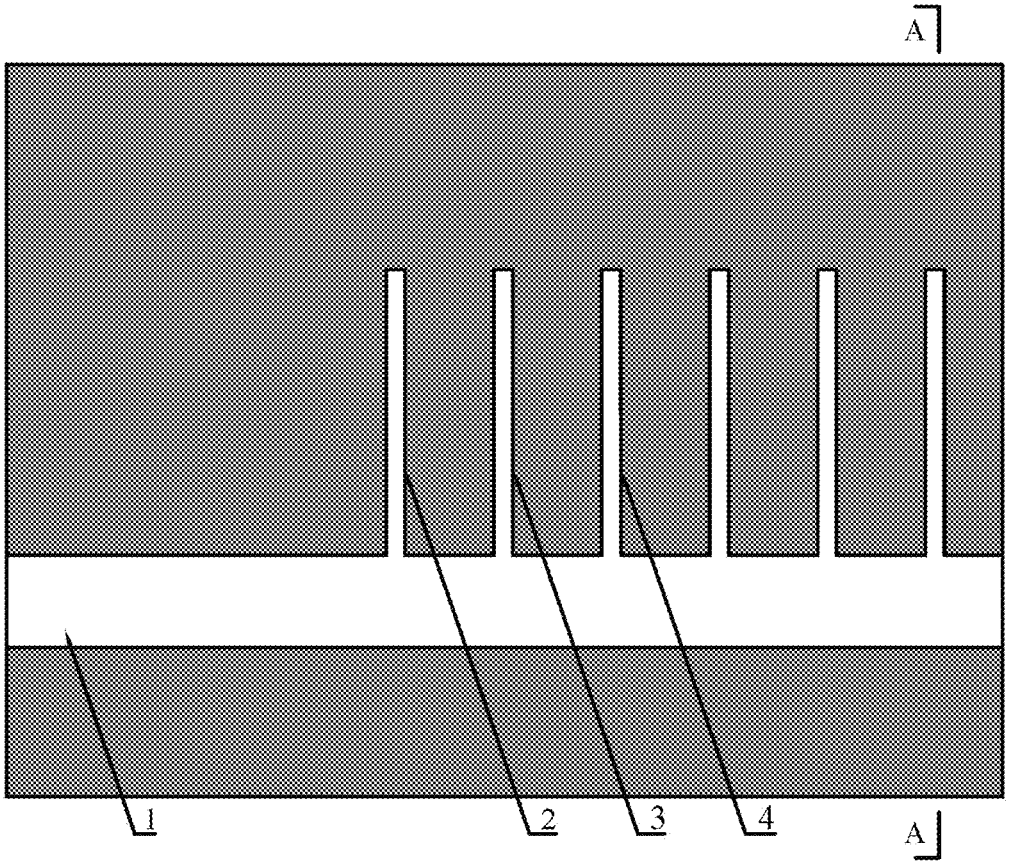
FIG. 1 is a construction plan of hydraulic fracturing drill holes in the present invention.

In the drawings: 1—roadway; 2—first fracturing drill hole of first row; 3—first fracturing drill hole of second row; 4—first fracturing drill hole of third row; 5—main roof above coal pillar; 6—immediate roof above coal pillar; 7—floor below coal pillar; 8—coal seam; 9—first-row drill hole coal pillar fracturing zone; 10—third-row drill hole floor fracturing zone; 11—second-row drill hole coal pillar fracturing zone; 12—first-row drill hole main roof fracturing zone; 13—third-row drill hole coal pillar fracturing zone; 14—coal pillar; 15—high-pressure pipeline; 16—hydraulic fracturing measuring and controlling instrument; 17—pressure relief valve; 18—transfer joint; 19—high-pressure thin hose; 20—high-pressure seal mounting rod; 21—packer; 22—hand pump; 23—hydraulic fracturing high-pressure pump; 24—switch valve I; 25—switch valve II; 26—hydraulic fracturing pulse pump; 27—three-way valve.

DESCRIPTION OF THE EMBODIMENTS

The present invention will be described below in detail with reference to the drawings.

The average thickness of the lower coal seam of a particular mine is 10 m; the roof of the lower coal seam is coarse sandstone with an average thickness of 6 m; the thickness of the upper coal seam is 4 m; the immediate roof of the upper coal seam is gravel-bearing coarse sandstone with an average thickness of 4 m; the main roof of the upper coal seam is sandstone with an average thickness of 4 m. The cross sections of the two crossheadings in the working face are rectangular cross sections, the supporting mode is bolt, cable and metal mesh combined support, and the two crossheadings are tunneled along the floor; the specification of the air intake roadway is: width*height=(5.3*3.5)$m^2$, the specification of the air return roadway is: width*height=(4.6*3.5)$m^2$; the two layers of coal pillars are overlapped, and the width of the coal pillars in the two working faces is 35 m.

Figure 2:
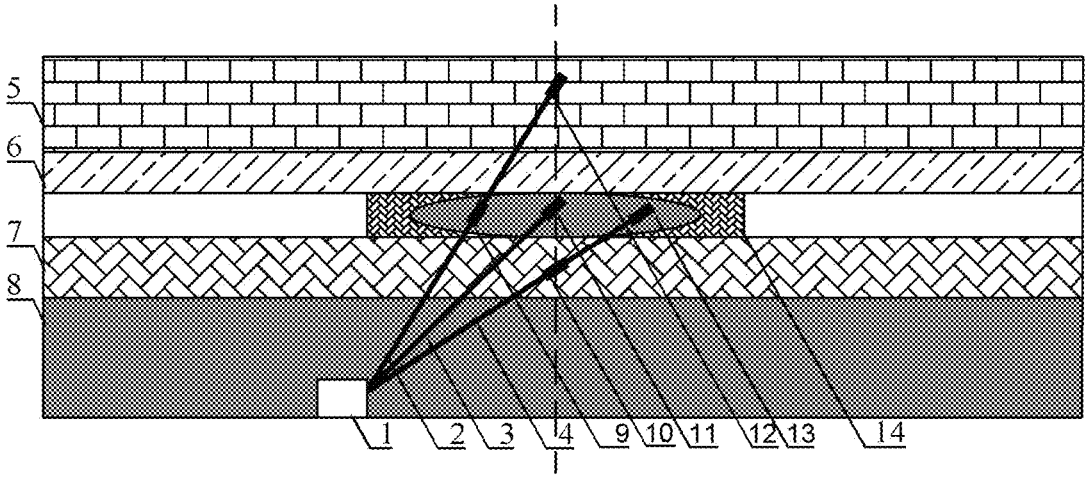
FIG. 2 is an A-A sectional view in FIG. 1.
Figure 3:
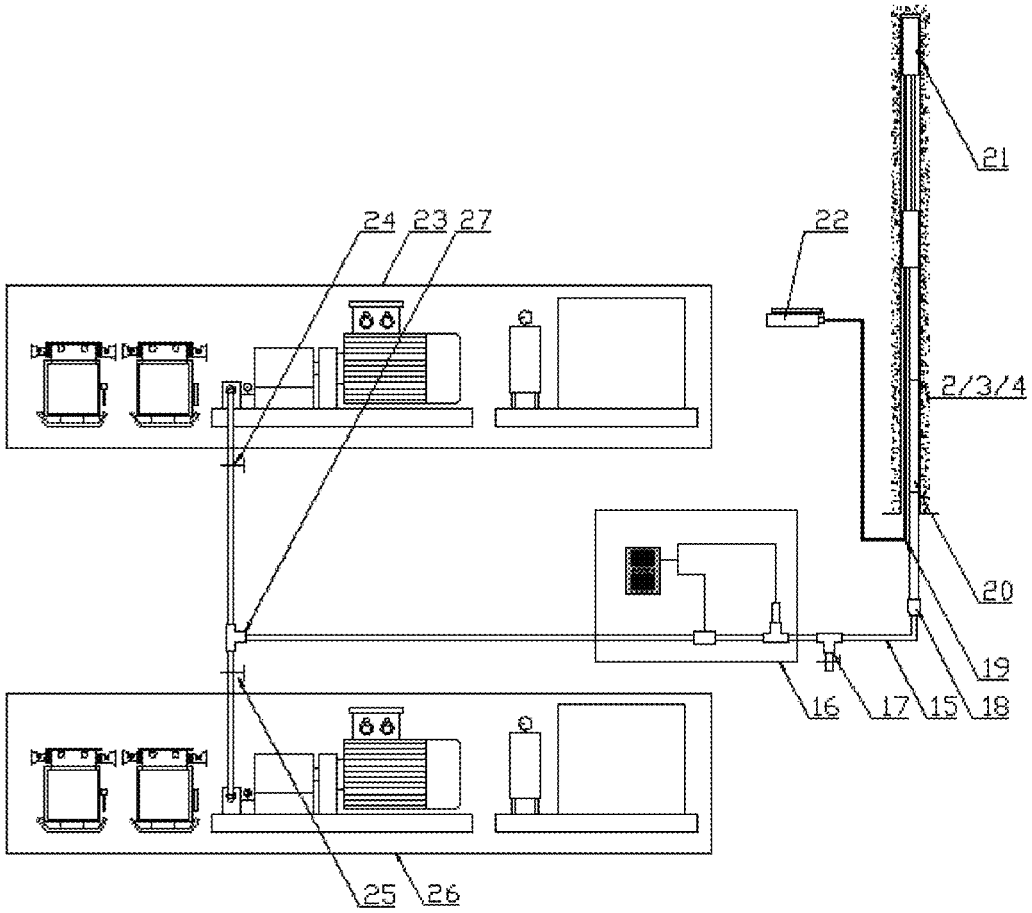
FIG. 3 is a drawing of hydraulic fracturing equipment used in the method provided by the present invention.

A fracturing relief method for stress concentration of remaining ore pillars in an overlying goaf is provided, and the specific steps are as follows:

As illustrated in FIG. 1 and FIG. 2, in step 1, three rows of fracturing drill holes are separately constructed in a roadway 1 at an interval in a direction oblique to the coal pillar in an upper goaf by using a drilling machine, where the hole drilling position is 1.2 m far away from the floor, the position of the final hole of the first row of fracturing drill holes is approximately 1 m above the middle of the main roof 5 above the coal pillar, the position of the final hole of the second row of fracturing drill holes is approximately 1 m above the middle of the coal pillar 14, and the position of the final hole of the third row of fracturing drill holes is at ¾ of the section of the coal pillar 14; the length of the drill holes is respectively 28 m, 23 m and 25 m, and the diameter of the drill holes is 75 mm. The arrangement of the drill holes is required to avoid the geological structure zones such as faults as much as possible according to geological information, so as to avoid the influence of the geological structure on the fracturing effect of the coal pillar.

In step 2, a hydraulic fracturing high-pressure pump 23 and a hydraulic fracturing pulse pump 26 are mounted and commissioned.

In step 3, a packer 21 is sent to the to-be-fractured area of a to-be-fractured drill hole, a high-pressure seal mounting rod 20, a transfer joint 18 and a high-pressure pipeline 15 are sequentially connected, and the high-pressure pipeline 15 is respectively connected to the hydraulic fracturing pulse pump 26 and the hydraulic fracturing high-pressure pump 23 through a three-way valve 27.

In step 4, first the hydraulic fracturing pulse pump 26 is turned off and the hydraulic fracturing high-pressure pump 23 is turned on to perform high-pressure hydraulic fracturing on the first drill hole of the first row, and then the hydraulic fracturing high-pressure pump 23 is turned off and the hydraulic fracturing pulse pump 26 is turned on to perform pulse hydraulic fracturing on the first drill hole of the first row.

The specific steps are as follows:

(a) the high-pressure seal mounting rod 20 is connected to the packer 21, the packer 21 is sent to a corresponding first-row drill hole main roof fracturing zone 12 in the first fracturing drill hole 2 of the first row, then the high-pressure pipeline 15 connected to the hydraulic fracturing high-pressure pump 23 and the hydraulic fracturing pulse pump 26 is connected onto the high-pressure seal mounting rod 20, and a hand pump 22 is used to infuse high-pressure water into the packer 21 through a high-pressure thin hose 19 to enable the packer 21 to be expanded and seal the hole, where a pressure relief valve 17 and a hydraulic fracturing measuring and controlling instrument 16 are arranged on the high-pressure pipeline 15;

(b) a switch valve II 25 is closed, a switch valve I 24 is opened, the hydraulic fracturing high-pressure pump 23 is turned on, and high-pressure water is infused into the drill hole through the high-pressure pipeline 15 to perform hydraulic fracturing; when the construction pressure monitored by the hydraulic fracturing measuring and controlling instrument 16 is smaller than 5 MPa or when the coal seam "sweats" for more than 5-7 min, the hydraulic fracturing high-pressure pump 23 is turned off and the pressure relief valve 17 is opened;

(c) sublevel retreating fracturing is adopted. the packer 21 is retreated to a corresponding first-row drill hole coal pillar fracturing zone 9, the hole is sealed again, the switch valve I 24 is closed, the switch valve II 25 is opened, and fracturing is performed again by using the hydraulic fracturing pulse pump 26; and (d) the packer 21 and the high-pressure seal mounting rod 20 are removed.

In step 5, the hydraulic fracturing high-pressure pump 23 is turned off and the hydraulic fracturing pulse pump 26 is turned on to perform pulse hydraulic fracturing on the first drill hole of the second row.

The specific steps are as follows:

(a) the high-pressure seal mounting rod 20 is connected to the packer 21, the packer 21 is sent to a corresponding second-row drill hole coal pillar fracturing zone 11 in the first fracturing drill hole 3 of the second row, then the high-pressure pipeline 15 connected to the hydraulic fracturing high-pressure pump 23 and the hydraulic fracturing pulse pump 26 is connected onto the high-pressure seal mounting rod 20, and a hand pump 22 is used to infuse high-pressure water into the packer 21 to enable the packer 21 to be expanded and seal the hole, where a pressure relief valve 17 and a hydraulic fracturing measuring and controlling instrument 16 are arranged on the high-pressure pipeline 15;

(b) a switch valve I 24 is closed, a switch valve II 25 is opened, the hydraulic fracturing pulse pump 26 is turned on, and pulse water is infused into the first fracturing drill hole 3 of the second row through the high-pressure pipeline 15 to perform hydraulic fracturing; when the construction pressure monitored by the hydraulic fracturing measuring and controlling instrument 16 is smaller than 5 MPa or when the coal seam "sweats" for more than 5-7 min, the hydraulic fracturing pulse pump 26 is turned off and the pressure relief valve 17 is opened; and (c) the packer 21 and the high-pressure seal mounting rod 20 are removed.

In step 6, the hydraulic fracturing high-pressure pump 23 is turned off and the hydraulic fracturing pulse pump 26 is opened to perform pulse hydraulic fracturing on the first drill hole of the third row. The specific steps are as follows:

(a) the high-pressure seal mounting rod 20 is connected to the packer 21, the packer 21 is sent to a corresponding third-row drill hole coal pillar fracturing zone 13 in the first fracturing drill hole 4 of the third row, then the high-pressure pipeline 15 connected to the hydraulic fracturing high-pressure pump 23 and the hydraulic fracturing pulse pump 26 is connected onto the high-pressure seal mounting rod 20, and a hand pump 22 is used to infuse high-pressure water into the packer 21 to enable the packer 21 to be expanded and seal the hole, where a pressure relief valve 17 and a hydraulic fracturing measuring and controlling instrument 16 are arranged on the high-pressure pipeline 15;

(b) a switch valve I 24 is closed, a switch valve II 25 is opened, the hydraulic fracturing pulse pump 26 is turned on, and pulse water is infused into the first fracturing drill hole 4 of the third row through the high-pressure pipeline 15 to perform hydraulic fracturing; when the construction pressure monitored by the hydraulic fracturing measuring and controlling instrument 16 is smaller than 5 MPa or when the coal seam "sweats" for more than 5-7 min, the hydraulic fracturing pulse pump 23 is turned off and the pressure relief valve 17 is opened;

(c) the packer 21 is retreated to a corresponding third-row drill hole floor fracturing zone 10 by adopting sublevel retreating fracturing, the hole is sealed again, the switch valve I 24 is closed again, the switch valve II 25 is opened, and fracturing is performed again by turning on the hydraulic fracturing pulse pump 26; and (d) the packer 21 and the high-pressure seal mounting rod 20 are removed.

Step 4 to step 6 are repeated till hydraulic fracturing of all three rows of fracturing drill holes is sequentially completed; the hydraulic fracturing sequence and the hole drilling construction sequence are the same, hydraulic fracturing and hole drilling are synchronously performed in parallel, the construction speed matches and the drill holes can be constructed in advance.

The first and third rows of fracturing holes are fractured by adopting sublevel retreating hydraulic fracturing, which further improves the utilization rate of drill holes. The specific steps are as follows:

(a) the hydraulic fracturing high-pressure pump 23 or the hydraulic fracturing pulse pump 26 is turned on;

(b) water is infused into a fracturing drill hole and a cycle of hydraulic fracturing is performed;

(c) when the hydraulic fracturing measuring and controlling instrument 16 monitors that the water pressure of the fracturing drill hole is smaller than 5 MPa or the coal seam "sweats" for more than 5-7 min, the hydraulic fracturing high-pressure pump 23 or the hydraulic fracturing pulse pump 26 is turned off, and the pressure relief valve 17 is opened to complete this cycle of hydraulic fracturing;

(d) the packer 21 is retreated for 5-20 m towards the hole mouth of the drill hole, and a cycle of hydraulic fracturing is performed again; and (e) the packer 21 is retreated to complete the sublevel retreating hydraulic fracturing.

Although the present invention has been described according to a limited number of embodiments, benefiting from the above description, one skilled in the art understands that other embodiments may be conceived within the scope of the present invention described herein. In addition, it should be noted that the language used in this description is selected mainly for readability and teaching purposes, rather than for the purpose of explaining or limiting the subject matter of the present invention. Therefore, without departing from the scope and spirit of the attached claims, many modifications and changes are obvious to one skilled in the art. For the scope of the present invention, the disclosure of the present invention is descriptive rather than restrictive, and the scope of the present invention is limited by the attached claims.

What is claimed is:

1. A fracturing relief method for stress concentration of remaining ore pillars in an overlying goaf, comprising the following steps:

step 1: separately constructing three rows of fracturing drill holes in a roadway to a set depth at an interval in a direction oblique to a coal pillar in an upper goaf by using a drilling machine, wherein a position of a final hole of a first row of the fracturing drill holes is 1 m above a middle of a main roof above the coal pillar, a position of a final hole of a second row of the fracturing drill holes is 1 m above a middle of the coal pillar, and a position of a final hole of a third row of the fracturing drill holes is at a section of ¾ of the coal pillar;

step 2: mounting and commissioning a hydraulic fracturing high-pressure pump and a hydraulic fracturing pulse pump;

step 3: sending a packer to a to-be-fractured area of a to-be-fractured drill hole, sequentially connecting a high-pressure seal mounting rod, a transfer joint and a high-pressure pipeline, and separately connecting the high-pressure pipeline to the hydraulic fracturing pulse pump and the hydraulic fracturing high-pressure pump through a three-way valve;

step 4: performing high-pressure hydraulic fracturing on a main roof area in the first row of the fracturing drill holes, and then performing pulse hydraulic fracturing on a coal pillar area in the first row of the fracturing drill holes;

step 5: performing pulse hydraulic fracturing on the second row of the fracturing drill holes; and step 6: performing pulse hydraulic fracturing on the coal pillar area in the third row of the fracturing drill holes, and then performing pulse hydraulic fracturing again on a floor area in the third row of the fracturing drill holes.

2. The fracturing relief method for the stress concentration of the remaining ore pillars in the overlying goaf according to claim 1, wherein, in step 4, the specific step of performing hydraulic fracturing on the first row of the fracturing drill holes comprises following steps:

(a) connecting the high-pressure seal mounting rod with the packer, sending the packer to a corresponding first-row drill hole main roof fracturing zone in a first fracturing drill hole of the first row, then connecting the high-pressure pipeline connected to the hydraulic fracturing high-pressure pump and the hydraulic fracturing pulse pump onto the high-pressure seal mounting rod, and using a hand pump to infuse high-pressure water into the packer through a high-pressure thin hose to expand the packer and seal the hole, wherein a pressure relief valve and a hydraulic fracturing measuring and controlling instrument are arranged on the high-pressure pipeline;

(b) closing a switch valve II, opening a switch valve I, turning on the hydraulic fracturing high-pressure pump, and infusing high-pressure water into the drill hole through the high-pressure pipeline to perform hydraulic fracturing; when a construction pressure monitored by the hydraulic fracturing measuring and controlling instrument is smaller than 5 MPa or when a coal seam sweats for more than 5-7 minutes, turning off the hydraulic fracturing high-pressure pump and opening the pressure relief valve;

(c) retreating the packer to a corresponding first-row drill hole coal pillar fracturing zone by adopting sublevel retreating fracturing, sealing the hole again, closing the switch valve I, opening the switch valve II, and performing fracturing again by using the hydraulic fracturing pulse pump; and (d) removing the packer and the high-pressure seal mounting rod.

3. The fracturing relief method for the stress concentration of the remaining ore pillars in the overlying goaf according to claim 2, wherein steps of drilling holes and hydraulic fracturing are synchronously performed in parallel and both the drilling holes and the hydraulic fracturing are conducted according to a sequence of a first fracturing drill hole of the first row, a first fracturing drill hole of the second row, a first fracturing drill hole of the third row, a second fracturing drill hole of the first row, a second fracturing drill hole of the second row, a second fracturing drill hole of the third row . . . an Nth fracturing drill hole of the first row, an Nth fracturing drill hole of the second row and an Nth fracturing drill hole of the third row.

4. The fracturing relief method for the stress concentration of the remaining ore pillars in the overlying goaf according to claim 1, wherein, in step 5, the specific step of performing hydraulic fracturing on the second row of the fracturing drill holes comprises following steps:

(a) connecting the high-pressure seal mounting rod with the packer, sending the packer to a corresponding second-row drill hole coal pillar fracturing zone in a first fracturing drill hole of the second row, then connecting the high-pressure pipeline connected to the hydraulic fracturing high-pressure pump and the hydraulic fracturing pulse pump onto the high-pressure seal mounting rod, and using a hand pump to infuse high-pressure water into the packer to expand the packer and seal the hole, wherein a pressure relief valve and a hydraulic fracturing measuring and controlling instrument are arranged on the high-pressure pipeline;

(b) closing a switch valve I, opening a switch valve II, turning on the hydraulic fracturing pulse pump, and infusing pulse water into the first fracturing drill hole of the second row through the high-pressure pipeline to perform hydraulic fracturing; when a construction pressure monitored by the hydraulic fracturing measuring and controlling instrument is smaller than 5 MPa or when a coal seam sweats for more than 5-7 minutes, turning off the hydraulic fracturing pulse pump and opening the pressure relief valve; and (c) removing the packer and the high-pressure seal mounting rod.

5. The fracturing relief method for the stress concentration of the remaining ore pillars in the overlying goaf according to claim 4, wherein steps of drilling holes and hydraulic fracturing are synchronously performed in parallel and both the drilling holes and the hydraulic fracturing are conducted according to a sequence of a first fracturing drill hole of the first row, a first fracturing drill hole of the second row, a first fracturing drill hole of the third row, a second fracturing drill hole of the first row, a second fracturing drill hole of the second row, a second fracturing drill hole of the third row . . . an Nth fracturing drill hole of the first row, an Nth fracturing drill hole of the second row and an Nth fracturing drill hole of the third row.

6. The fracturing relief method for the stress concentration of the remaining ore pillars in the overlying goaf according to claim 1, wherein, in step 6, specific step of performing hydraulic fracturing on the third row of the fracturing drill holes comprises following steps:

(a) connecting the high-pressure seal mounting rod with the packer, sending the packer to a corresponding third-row drill hole coal pillar fracturing zone in a first fracturing drill hole of the third row, then connecting the high-pressure pipeline connected to the hydraulic fracturing high-pressure pump and the hydraulic fracturing pulse pump onto the high-pressure seal mounting rod, and using a hand pump to infuse high-pressure water into the packer to expand the packer and seal the hole, wherein a pressure relief valve and a hydraulic fracturing measuring and controlling instrument are arranged on the high-pressure pipeline;

(b) closing a switch valve I, opening a switch valve II, turning on the hydraulic fracturing pulse pump, and infusing pulse water into the first fracturing drill hole of the third row through the high-pressure pipeline to perform hydraulic fracturing; when a construction pressure monitored by the hydraulic fracturing measuring and controlling instrument is smaller than 5 MPa or when a coal seam sweats for more than 5-7 minutes, turning off the hydraulic fracturing pulse pump and opening the pressure relief valve;

(c) sublevel retreating fracturing being adopted, retreating the packer to a corresponding third-row drill hole floor fracturing zone, sealing the hole again, closing the switch valve I again, opening the switch valve II, and performing fracturing again by turning on the hydraulic fracturing pulse pump; and (d) removing the packer and the high-pressure seal mounting rod.

7. The fracturing relief method for the stress concentration of the remaining ore pillars in the overlying goaf according to claim 6, wherein steps of drilling holes and hydraulic fracturing are synchronously performed in parallel and both the drilling holes and the hydraulic fracturing are conducted according to a sequence of a first fracturing drill hole of the first row, a first fracturing drill hole of the second row, a first fracturing drill hole of the third row, a second fracturing drill hole of the first row, a second fracturing drill hole of the second row, a second fracturing drill hole of the third row . . . an Nth fracturing drill hole of the first row, an Nth fracturing drill hole of the second row and an Nth fracturing drill hole of the third row.

8. The fracturing relief method for the stress concentration of the remaining ore pillars in the overlying goaf according to claim 1, wherein steps of drilling holes and hydraulic fracturing are synchronously performed in parallel and both the drilling holes and the hydraulic fracturing are conducted according to a sequence of a first fracturing drill hole of the first row, a first fracturing drill hole of the second row, a first fracturing drill hole of the third row, a second fracturing drill hole of the first row, a second fracturing drill hole of the second row, a second fracturing drill hole of the third row . . . an Nth fracturing drill hole of the first row, an Nth fracturing drill hole of the second row and an Nth fracturing drill hole of the third row.

9. The fracturing relief method for the stress concentration of the remaining ore pillars in the overlying goaf according to claim 8, wherein a group of fracturing areas for directional fracturing are arranged in the main roof above the coal pillar; three groups of fracturing areas are arranged in the coal pillar; and a group of fracturing areas are arranged in the floor below the coal pillar.

* * * * *